US006249485B1

(12) United States Patent
Hillis

(10) Patent No.: US 6,249,485 B1
(45) Date of Patent: Jun. 19, 2001

(54) BIT SERIAL MECHANICAL ADDER

(75) Inventor: W. Daniel Hillis, Toluca Lake, CA (US)

(73) Assignee: The Long Now Foundation, Sausalito, CA (US)

( * ) Notice: Subject to any disclaimer, the term of this patent is extended or adjusted under 35 U.S.C. 154(b) by 0 days.

(21) Appl. No.: 08/987,603

(22) Filed: Dec. 10, 1997

(51) Int. Cl.[7] ..... G04B 19/22
(52) U.S. Cl. ..... 368/20; 368/28
(58) Field of Search ..... 368/15–19, 20, 368/28

(56) References Cited

U.S. PATENT DOCUMENTS 165,432 * 7/1875 Terry ..... 368/20
3,031,654 * 4/1962 Galen ..... 368/20
3,316,706 * 5/1967 Kilburg ..... 368/20
3,524,313 * 8/1970 Wood ..... 368/20
3,807,166 * 4/1974 Meitinger ..... 368/35

* cited by examiner

*Primary Examiner*—Bernard Roskoski
(74) *Attorney, Agent, or Firm*—Michael A. Glenn

(57) ABSTRACT

A mechanical device converts one time base to another without using gears to do so. A mechanical adder adds a constant into an accumulator at regular intervals. The interval is generated by the overflow of the accumulator. In the case where a signal is to be generated once every solar year from a wheel that rotates only once per day, the fractional number 1/365.242198 is added to the accumulator each day by the rotation of a day wheel. Whenever the accumulation overflows, the one-year signal is generated. The fractional portion of the accumulated sum remains in the accumulator, such that round-off errors do not accumulate over time. The preferred adder is digital, such that this computation may be carried out to any desired level of precision. Additionally, the same design, but with a different constant, may be used to generate other intervals (e.g. for lunar months).

36 Claims, 7 Drawing Sheets

BIT SERIAL MECHANICAL ADDER

BACKGROUND OF THE INVENTION

1. Technical Field

The invention relates to mechanical clocks. More particularly, the invention relates to a mechanical device for converting one time base to another.

2. Description of the Prior Art

A clock which displays multiple intervals, such as hours and days, requires a mechanism for converting the basic time base, such as the wing of a pendulum, into the displayed intervals, e.g. hours. This is normally accomplished with a gear train, which works well when the intervals displayed are integer multiples of the period of the time base. However, such integral multiple relationship is not achievable when the displayed intervals do not bear a simple rational relationship to one another. This is the case, for example, when the intervals displayed are constants, such as lunar months and solar years, which are approximately 29.5303882 days and 365.242198 days, respectively. The calendar is arranged to add a day each fourth year to compensate roughly for this mismatch between the calendar year and the solar year, i.e. an extra day is added to the month of February during leap years. Such factors are also readily taken into account with electronic time keeping systems. However, in a mechanical clock that uses a gear train, these constants must be approximated by a ratio of numbers. If conventional mechanical techniques are used, a gear train having a very large number of gear teeth is required to achieve an accurate approximation of such constants.

It would be advantageous to provide a mechanical device that achieves an accurate approximation of such constants as lunar months and solar years without requiring a complex gear train, e.g. a gear train having a very large number of gear teeth.

SUMMARY OF THE INVENTION

The invention provides a mechanical device for converting one time base to another without using gears to do so. The preferred embodiment of the invention is a mechanical adder that adds a constant into an accumulator at regular intervals. The interval is generated by the overflow of the accumulator. For example, consider the case where a signal is to be generated once every solar year from a wheel that rotates once per day. In such case, the fractional number $1/365.242198$ is added to the accumulator each day by the rotation of the day wheel. Whenever the accumulation overflows, the one-year signal is generated. The fractional portion of the accumulated sum remains in the accumulator, such that round-off errors do not accumulate over time. The preferred adder is digital, such that this computation may be carried out to any desired level of precision. Additionally, the same design, but with a different constant, may be used to generate other intervals (e.g. for lunar months).

DETAILED DESCRIPTION OF THE INVENTION

Figure 1:
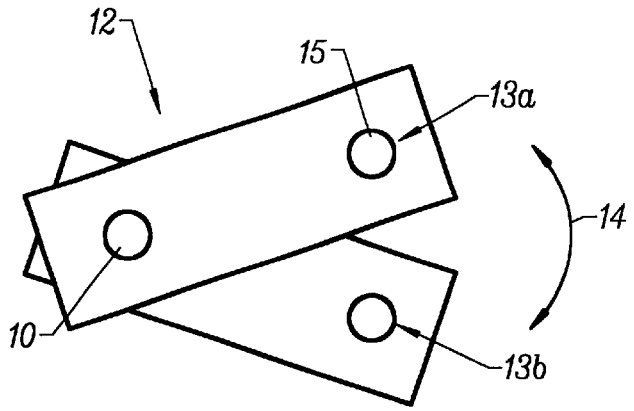
FIG. 1 is a schematic plan view of a bit lever for a bit serial mechanical adder according to the invention.

The invention provides a mechanical device for converting one time base to another without using gears to do so. The invention is used in a mechanical clock. It is contemplated that the invention will find application in a millennium clock (see D. Hillis, the millennium clock, Wired Scenarios (1997)). The millennium clock is a mechanical clock that ticks once every solar year. It has a century hand that advances once every 100 years, and a cuckoo the comes out on the millennium. The purpose of such clock is to challenge and change the way time is viewed, and thereby extend the human perspective from the ephemeral and insignificant span of years encompassed in an individual life time to the millennia of human civilization.

Because such a clock must operate continuously for a period of time that is longer than the present recorded history of the human race, it is thought that such clock must be, of necessity, a mechanical clock (it is extremely unlikely that a source of electrical power could be supplied without interruption for such a long interval). Hence, the implementation of the clock mechanism without electrical or electronic components.

Further, because such a clock must be accurate for such a long period of time, it is necessary to provide the herein described invention within such a mechanical clock to reconcile the convenient but inaccurate time keeping conventions of the calendar, e.g. the calendar year, with the reality of planetary time, e.g. the solar year.

Finally, because such clock should be self regulating and require minimal maintenance, the clock's design must contemplate various strategies that avoid the degradation and decay that is attendant with most mechanical devices over time. In this regard, it is thought that the use of conventional gear trains is inappropriate for a clock of this type. Rather, a design is provided in which all parts are in regular and continuous motion, such that friction (or worse, binding), which results from such factors as oxidation (i.e. rust) when mechanical parts remain idle for extended periods, is avoided.

The preferred embodiment of the invention is a mechanical adder that adds a constant into an accumulator at regular intervals. The interval is generated by the overflow of the accumulator. For example, consider the case where a signal is to be generated once every solar year from a wheel that rotates only once per day. In such case, the fractional number $1/365.242198$ is added to the accumulator each day by the rotation of a day wheel (see the discussion of the base portion, track, and slider below). Whenever the accumulation overflows, the one-year signal is generated. The fractional portion of the accumulated sum remains in the accumulator, such that round-off errors do not accumulate over time. The preferred adder is digital, such that this computation may be carried out to any desired level of precision. Additionally, the same design, but with a different constant, may be used to generate other intervals (e.g. for lunar months).

The bit serial mechanical adder adds a constant K into an accumulator. The number K and the sum of such additions to the accumulator are both represented as binary numbers.

A simple bit serial addition might involve adding the numbers 3 and 5. These numbers are represented in binary form as 011 and 101, respectively. When the least significant bits are added, i.e. 1 and 1, a carry is generated that is propagated to the next least significant bit, which generates yet another carry that is propagated to the most significant bit. The result is the number eight, expressed in binary format as 1000. In the preferred embodiment of the invention, addition to the accumulator is performed in bit serial order, from the least significant bit to the most significant bit. Levers are provided that represent the bits in the accumulator, while pins are provided to represent the function of the bit serial adder, i.e. writing to a bit or resetting a bit. Because the carry input, the constant bit K, and the accumulator bit can each be zero or one, there are eight possible combinations of inputs to the bit serial adder. Table 1 below shows the accumulator bit and carry outputs that result for each such combination of inputs.

TABLE 1

Mathematical Representation of the Bit Serial Adder

| Inputs | | In Count | | Output | |
|---|---|---|---|---|---|
| A In | K Bit | Carry In | (One's) | A Out | Carry Out |
| 0 | 0 | 0 | 0 | 0 | 0 |
| 0 | 0 | 1 | 1 | 1 | 0 |
| 0 | 1 | 0 | 1 | 1 | 0 |
| 0 | 1 | 1 | 2 | 0 | 1 |
| 1 | 0 | 0 | 1 | 1 | 0 |
| 1 | 0 | 1 | 2 | 0 | 1 |
| 1 | 1 | 0 | 2 | 0 | 1 |
| 1 | 1 | 1 | 3 | 1 | 1 |

FIG. 1 is a schematic plan view of a bit lever 12 for a bit serial mechanical adder according to the invention. The bits in the accumulator are stored in levers that can be set in one of two positions, where such positions represent a digital zero and one, respectively. Each bit corresponds to one lever. While only one lever is shown in FIG. 1, it should be appreciated that any number of levers (i.e. bits may be provided as desired). In FIG. 1, the line identified by numeric designator 14 indicates how a lever swings so that a bit pin 15 arcs substantially vertically about a pivot point 10 between a zero position 13*b* and a one position 13*a*.

Figure 2:
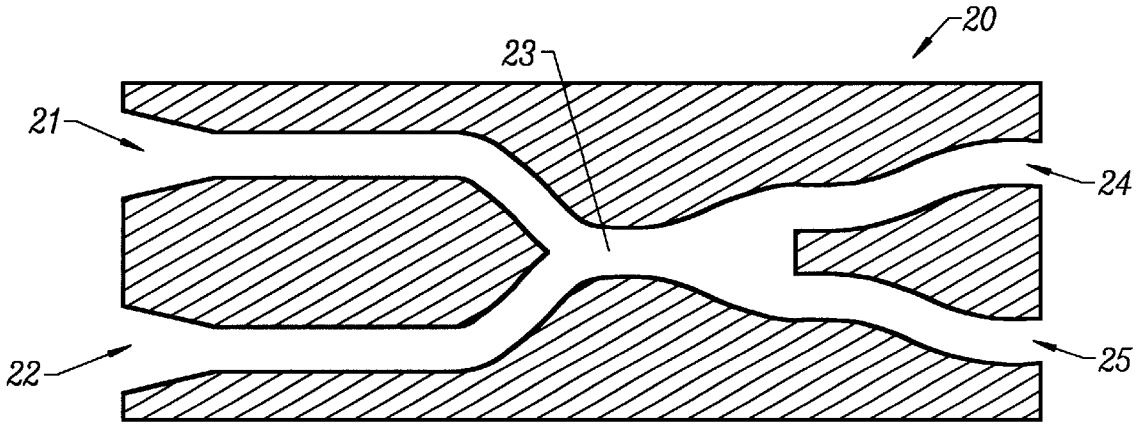
FIG. 2 is a schematic plan view of a track switch section for a bit serial mechanical adder according to the invention.

FIG. 2 is a is a schematic plan view of a track switch section for a bit serial mechanical adder according to the invention. Each lever is normally held in one of the two positions by a track 20 in which the bits pins slide. A switch section in the track allows the bit pin to move from one track 21/24 to another 22/25 when the bit is written. A bit pin, for example a one, enters the track switch section on track 21. The pin is forced by the track to a neutral position 23. As the pin continues to traverse the track, the pin either retains its present value in which case the pin stays on the one track (at this point track 24), or the pin is reset (i.e. there is a writing operation) by a slider (discussed below) in which case the pin is forced to the zero track (at this point track 25).

Figure 3:
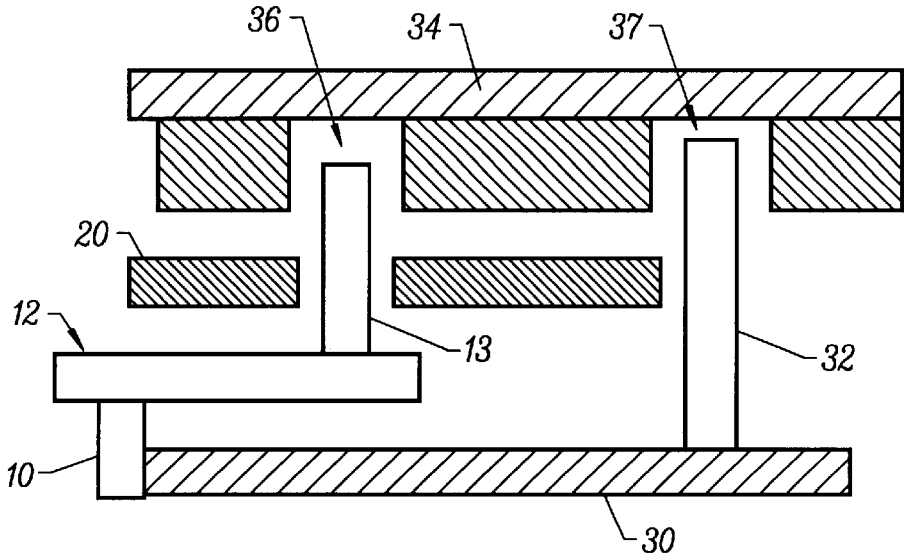
FIG. 3 is a schematic end view of a bit serial mechanical adder according to the invention.

FIG. 3 is a schematic end view of a bit serial mechanical adder according to the invention. The switching of the bit pin 15, either up or down, is determined by a slider 34 that rides over the switch section of the track 20. The constant bit K is represented by pins 32 that are fixed in either the zero or one position. Thus, there is one lever with a bit pin, and one fixed constant bit K pin for each bit position.

FIG. 3 shows the vertical relationship between the parts of the bit serial adder. The levers and constant pins are fixed in a base 30 and the track slides over the lever and engages the bit pin. The slider includes slots 36, 37 that engage the bit pins and the constant bit K pins, respectively. While the track slides over the levers in the preferred embodiment of the invention, it is also possible for the track to remain stationary and for the base to be moved relative to the track and the slider in other embodiments of the invention. Further, it should be appreciated that only the portion of the track which includes the switch section is shown. In the preferred embodiment of the invention, the track is continuous with the base, such that each bit is held in place by the track at all times. Thus, the mechanism is locked, such that the bits remain stable against unwanted movement that might result from, for example, vibration.

Figure 4:
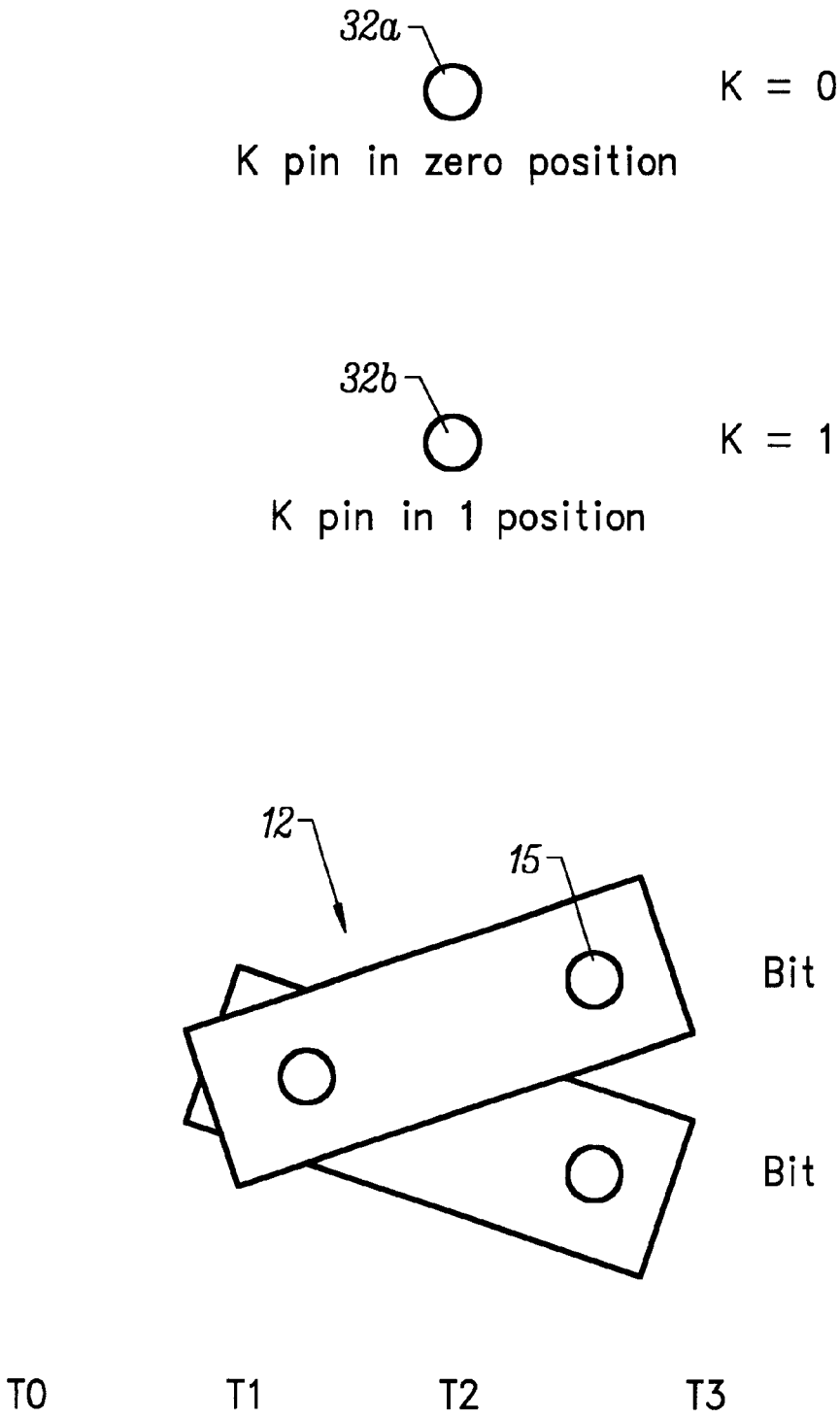
FIG. 4 is a plan view showing the relative position of two constant pins in a base portion of a bit serial mechanical adder and a bit pin in both a digital one and zero position, according to the invention.

FIG. 4 is a plan view showing the relative position of two constant bit K pins 32*a*, 32*b* in a base portion of a bit serial mechanical adder and a bit pin 15 in both a digital "0" and "1" position, according to the invention. Although the constant bit K pins and bit pins are shown in both the zero and one position, a given word would actually only have one of each pin, in one position or the other. Additional bits are placed to the left or right, aligned horizontally so that, for instance, all constant bit K pins are aligned on the same horizontal line, and all bits in position one are aligned on the same horizontal line. The concatenation of the values stored in the pins in both the constant bit K horizontal line and along the zero and one tracks provides the actual constant value K that is added to the accumulator during each interval and the sum that is stored in the accumulator. That is, the constant bit K pins encode the constant value, while the bit pins store the accumulated value.

A complete traversal of the base by the track and slider completes an interval. This interval may be one day, for example as represented by the fractional number $1/365.242198$, or it may be a calendar year or other interval. Because it is preferred that the interval repeat continuously, such that any remainder in the accumulator is retained and added to the next interval, it is necessary for the track and slider to return to a point of origin along the base. Further, because physically relocating the track and slider from an end of the base to a beginning thereof would introduce a time error, it is preferred that the base be arranged such that the end thereof meets the beginning thereof.

For example, the base may be curved, such that it assumes the shape of a wheel, where the track and slider traverse the rim of such wheel. In this embodiment, either the base wheel may turn at a constant rate such that one revolution completes an interval, or the track and slider may move about the rim of the wheel, such that one traversal of the rim completes an interval. In the case where the wheel is a day wheel, one traversal (or rotation) thereof records the fractional number for a day and approximately 365 traversals (or rotations) thereof complete a solar year. At the end of a solar year in this embodiment of the invention, the most significant bit in the accumulator would contain a one, indicating that a year has been accumulated, and the less significant bits in the accumulator would contain the fractional number 0.242198, which would then be added to the sum accumulated for the following year.

The horizontal dimension of the base is divided into units. These units are labeled T0, T1, T2, and T3 in FIG. 4. In the preferred embodiment of the invention, each bit position takes up exactly four units. The levers and constant bit K pins are positioned so that they are exactly one unit apart in the horizontal dimension. The constant bit K pins are exactly one unit to the left of the bit pins.

In operation of one embodiment of the adder, the base remains stationary and the track and slider move to the left, passing over one bit at a time. The bits are arranged from least significant bit to most significant bit moving left to right. The slider is constrained to move from left to right along with the track, but the slider is free to move from top to bottom independently. This top-to-bottom motion is controlled by the engagement and disengagement of the pins. As the slider moves over the bits, these pins engage in four different cycles (T0, T1, T2, and T3).

During the first cycle T0, the bit pin drives the slider. In this way, the slider reads the bit pin value as being either a one or a zero. That is, the bit pin positions the slider, such that the position of the slider reflects the value of the bit pin.

During the second cycle, the constant bit K pin drives the slider. This action adds the constant K value to the bit value recorded for the bit. If the constant bit K value is zero, then the slider does not move. If the constant bit K value is one, the position of the slider reflects both the value of the constant bit K pin and the value of the bit pin read during the first cycle.

During the third cycle, the constant bit K pin holds the slider and the slider drives the bit pin to switch the bit to the appropriate track. This action may be thought of as writing the bit.

During the fourth cycle, the constant bit K pin drives the slider such that it is positioned to be in the correct position for the next bit.

Roughly speaking, the four cycles correspond to read bit, read constant bit K, write bit, and reset. The four cycles are shown in Table 2 below. During any given cycle, the position of the slider is controlled by exactly one pin. During transitions between the cycles, the slider is actually held reluctantly by two pins during the overlap period.

TABLE 2

The Function of Cycles T0, T1, T2, and T3

| Cycle | Function |
|---|---|
| T0 | Read bit pin |
| T1 | Read K pin |
| T2 | Write bit pin, reset 3 to 2 |
| T4 | Reset 2 to 1, reset 1 to 0 |

The logic of the slider circuit depends upon the fact that the addition function is symmetrical among the three input bits. That is, the addition function depends only on the relative numbers of one's and zero's in the inputs, as indicated in the count column in Table 1. The count indicates the number of one's that are in the three inputs. These four possibilities, zero, one, two, and three, correspond to the four possible positions of the slider. In effect, the vertical position of the slider counts the number of one's on the inputs that have been dealt with by the system.

When the slider enters a bit position at time T1, the slider is either in the zero position (shown on FIG. 5) or the one position (shown in FIG. 6), depending upon whether or not there is a carry input. When the bit pin is in the one position, the slider is advanced (forced downward by the bit pin) one position. p In this case, if the slider is in the zero position, it is moved to the one position; and if the slider is in the one position (indicating a carry input), it is moved to the two position (shown in FIG. 7).

On cycle two T2, the slider is advanced if the constant K is equal to one, but it is not advanced if the constant K is equal to zero. During cycle two, the bit pin is also steered to the neutral position by the track.

In the third cycle T3, the constant K pin holds the slider stationary in whatever position it is in, unless the slider is in position three, in which case the slider is reset in this cycle. During this cycle, the bit pin is steered from the neutral position to the appropriate output, and the slider is reset to either the zero position or the one position, depending upon whether or not there is a carry output.

Figure 5:
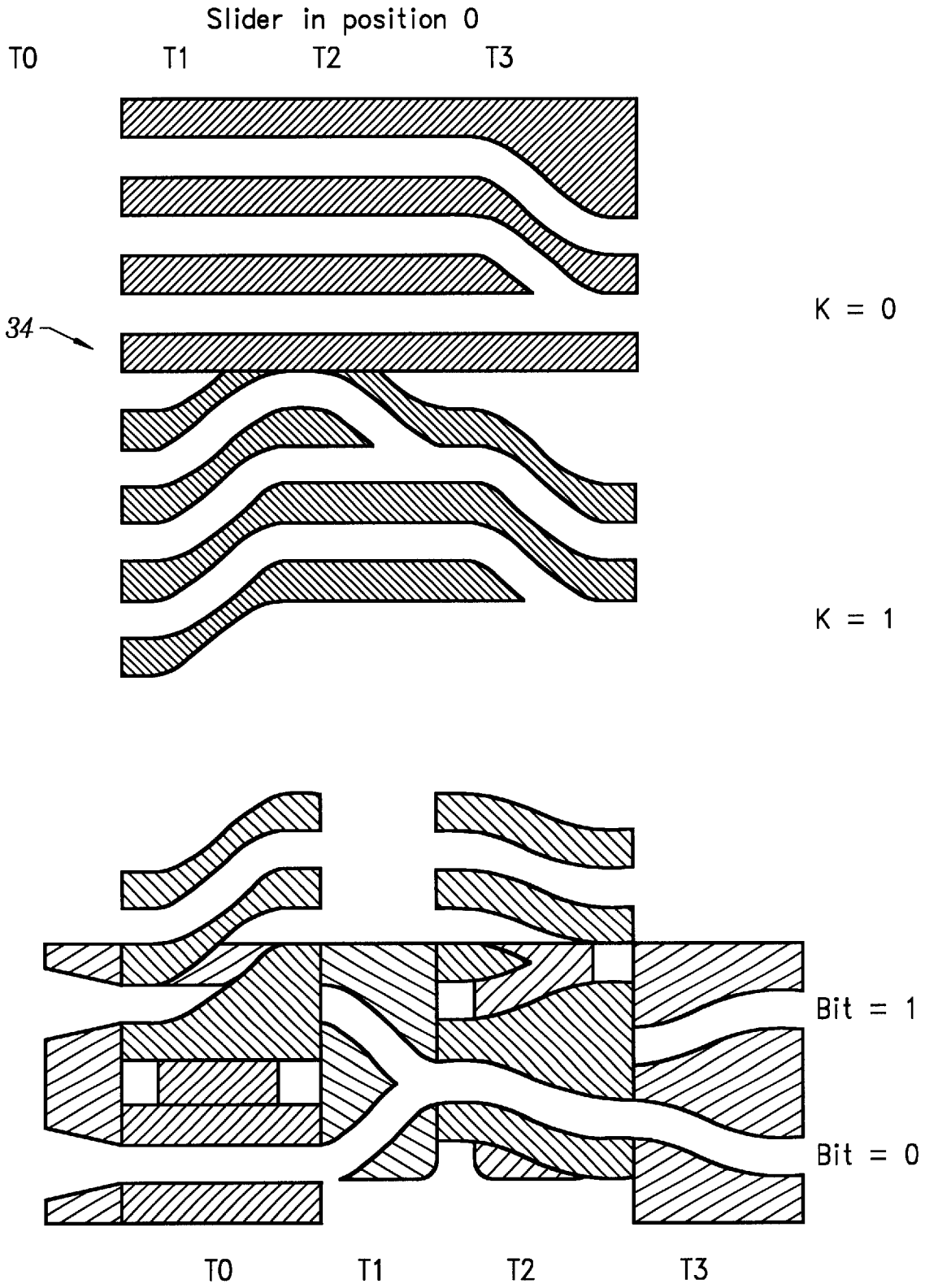
FIG. 5 is a plan view of a slider for a bit serial mechanical adder in a time zero position according to the invention.
Figure 6:
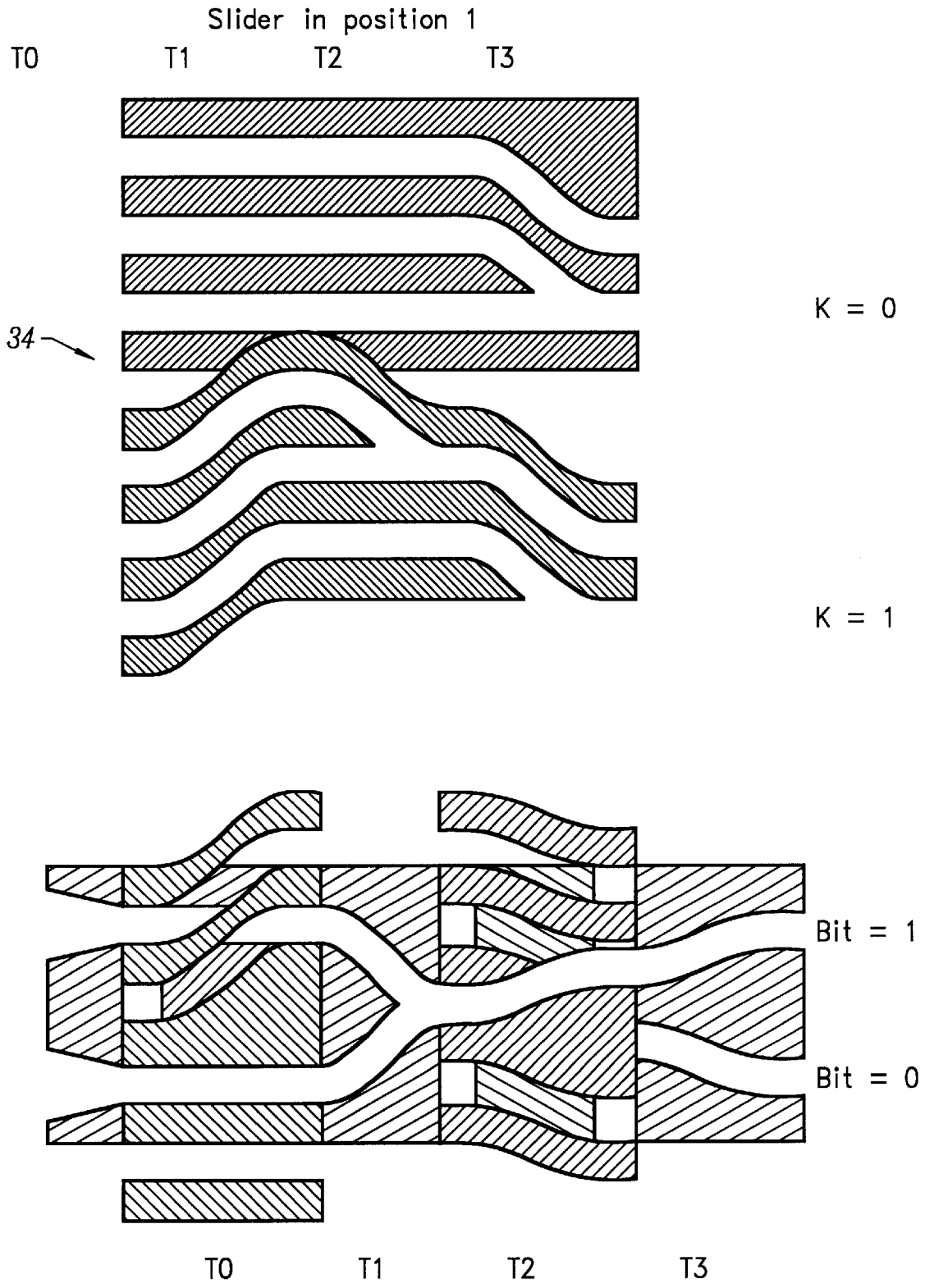
FIG. 6 is a plan view of a slider for a bit serial mechanical adder in a time one position according to the invention.
Figure 7:
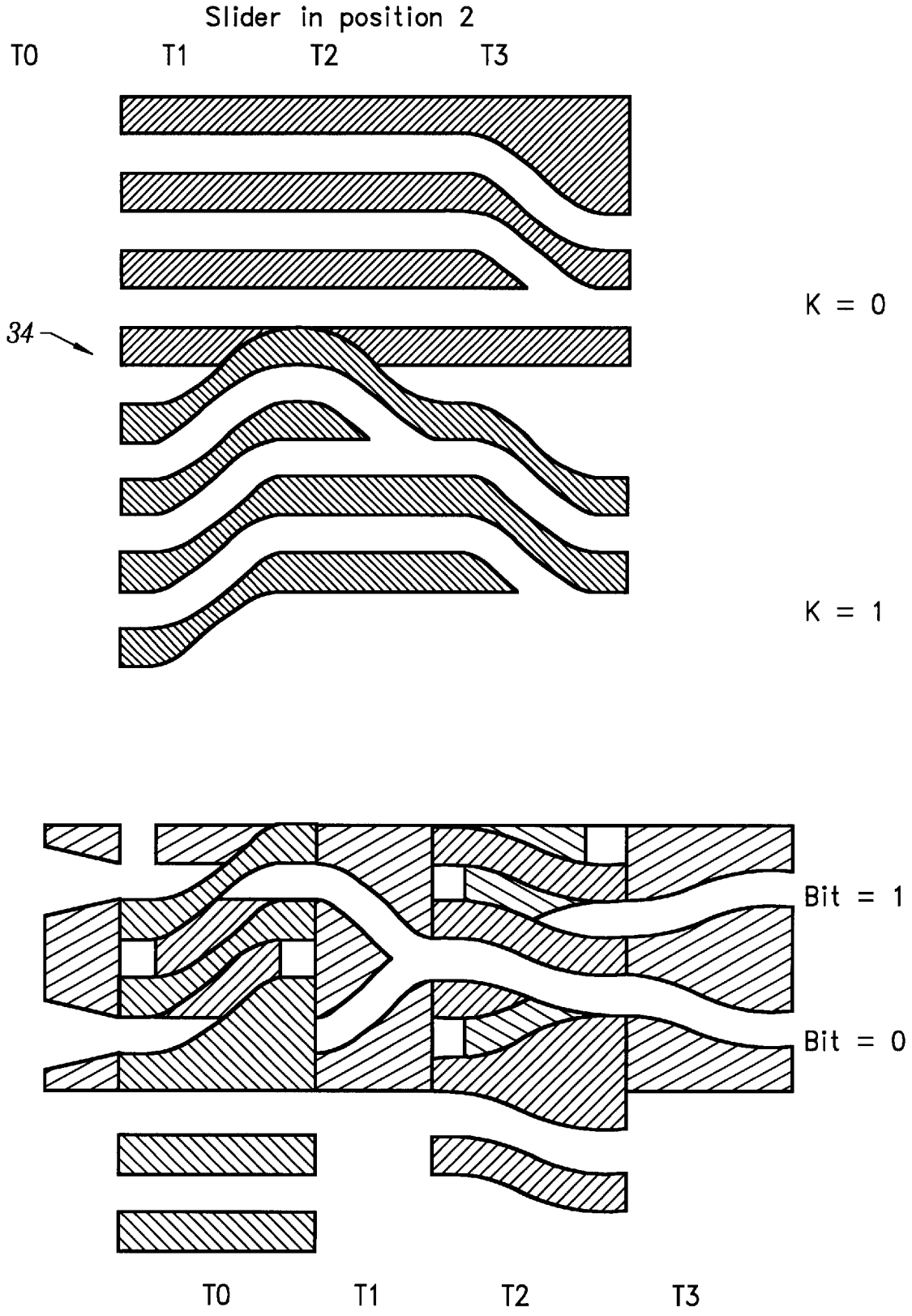
FIG. 7 is a plan view of a slider for a bit serial mechanical adder in a time two position according to the invention.
Figure 8:
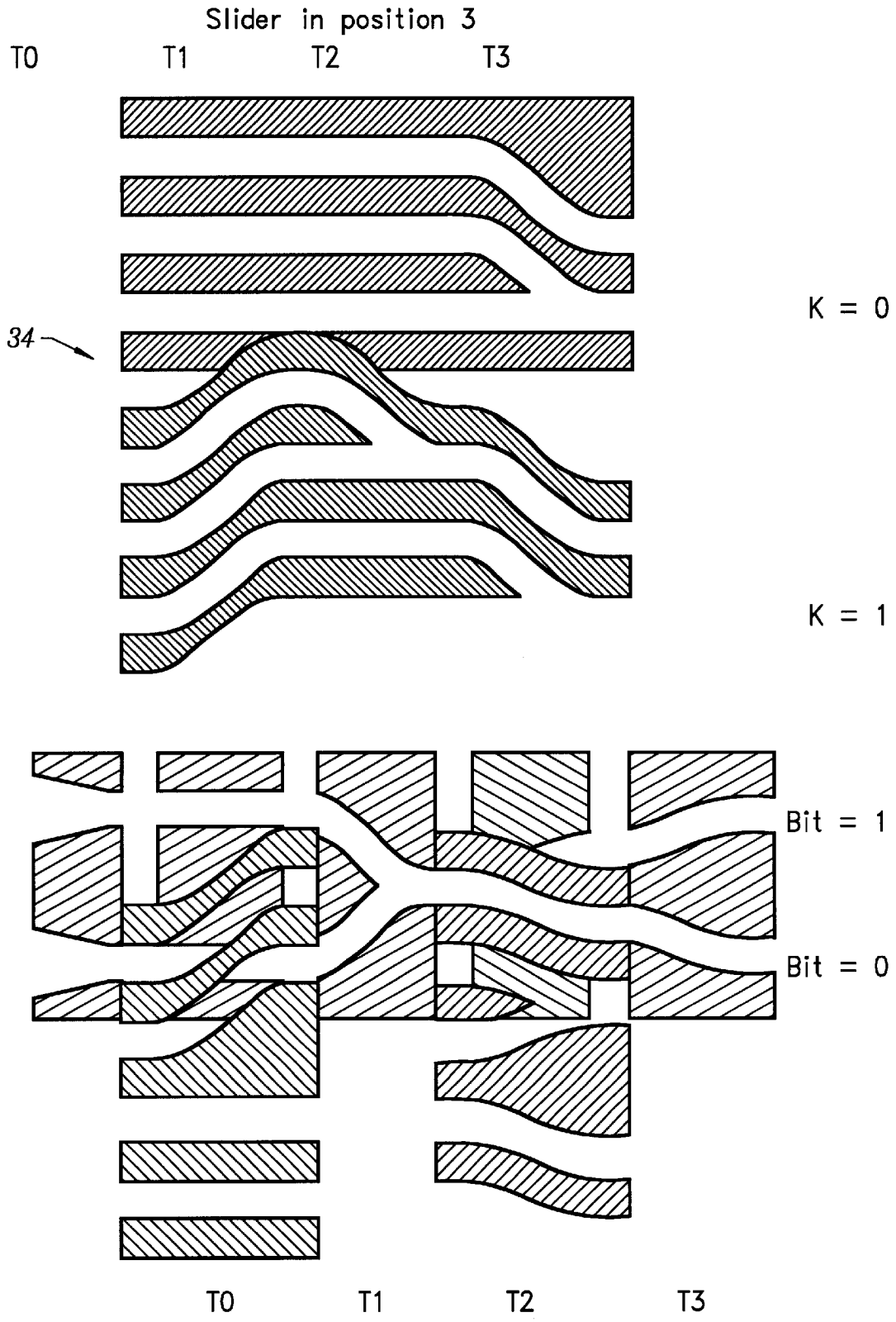
FIG. 8 is a plan view of a slider for a bit serial mechanical adder in a time three position according to the invention.

FIGS. 5–8 show the slider in each of the four possible positions. Each of FIGS. 5–8 are drawn for an embodiment of the invention in which the track is straight and the slider moves in a straight line. FIG. 5 is a plan view of a slider 34 for a bit serial mechanical adder in a zero position, FIG. 6 is a plan view of the slider in position one, FIG. 7 is a plan view of the slider in position two, and FIG. 8 is a plan view of the slider in position three.

Figure 9:
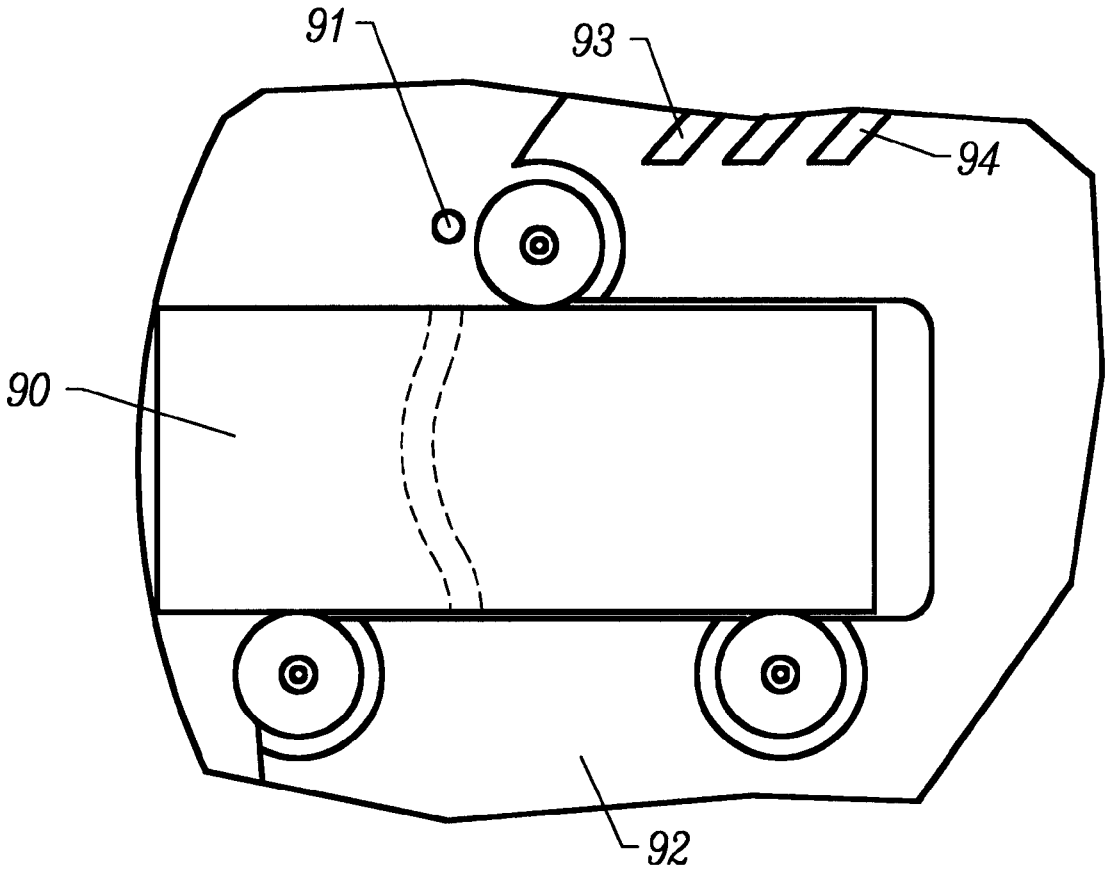
FIG. 9 is a plan view of a mechanical bit serial adder having a circular configuration.

FIG. 9 is a plan view of a mechanical bit serial adder having a circular configuration. This alternative embodiment of the invention provides a circular track 94 in which the units T0, T1, T2, and T3 correspond to fixed angles, rather than fixed distances. In this embodiment of the invention, multiple bit levers 91, 93 are placed on a base 92 around the device on a circle with each bit corresponding to a fixed angle. For example, because one track, e.g. the bit-equals-zero track (or, alternatively the bit-equals-one track) has a smaller radius than the bit-equals-one track, those portions of the slider 90 which engage with the K-equals-zero pin 91 are longer, even though they have the same angle. Because different portions of the track are intended to engage different pins (which occurs in one of four different radii), implementation of the invention in a circular embodiment of the invention is more complicated than the uniform, rectangular to polar conversion required for the rectangular embodiment of the invention described above. Thus, each slot must be distorted to fit the pin at the appropriate radius, at which point it engages the pin. All of the tracks that engage the same pin are therefore curved on exactly the same radius.

Although the invention is described herein with reference to the preferred embodiment, one skilled in the art will readily appreciate that other applications may be substituted for those set forth herein without departing from the spirit and scope of the present invention. For example, although the preferred embodiment is discussed in connected with a timing mechanism, the invention is readily used in any logical application the requires a bit serial adder function. Accordingly, the invention should only be limited by the Claims included below.

I claim:

1. An apparatus for converting one time base to another, comprising:

an accumulator: and a digital mechanical adder that automatically adds a constant into said accumulator at regular intervals, wherein an interval indication is provided by the overflow of said accumulator;

wherein a fractional portion of an accumulated sum remains in said accumulator after an interval indication is provided, such that round-off errors do not accumulate over time.

2. The apparatus of claim 1, wherein an indication once every solar year from a wheel that rotates only once per day.

3. The apparatus of claim 1, wherein a fractional number is added to the accumulator each day by rotation of a day wheel.

4. The apparatus of claim 1, wherein a one-year indication occurs whenever said accumulator overflows.

5. A mechanical adder, comprising:

an accumulator; and a bit serial mechanical adder that adds an addend into said accumulator upon the occurrence of a rotation event;

wherein said addend and the sum of additions to said accumulator are both represented as binary numbers; a plurality of levers that each further comprise a pin that represents a bit in said accumulator, wherein said levers can be set in one of two positions, where such positions represent a digital zero and one, respectively and where each lever is held in one of two said positions by a track device in which said pins slide.

6. The adder of claim 5, wherein addition to said accumulator is performed in bit serial order from least significant bit to most significant bit.

7. The adder of claim 6, said track device further comprising:

at least two substantially parallel tracks; and a switch section which allows said pin to move from one track to another when a bit is written.

8. The adder of claim 7, wherein the switching of said pin is determined by a slider that rides over said switch section of said track device.

9. The adder of claim 8, further comprising:

a plurality of fixed pins that represent said addend.

10. The adder of claim 9, wherein there is one lever having a pin, and one fixed addend pin for each bit position.

11. The adder of claim 10, wherein said slider includes slots that engage said bit pins and said addend pins, respectively.

12. The adder of claim 11, further comprising:

a base in which said levers and addend pins are fixed.

13. The adder of claim 12, wherein said track slides over each lever and engages said pin.

14. The adder of claim 13, wherein said track remains stationary and said base is moved relative to said track and said slider.

15. The adder of claim 13, wherein said track is continuous with said base, such that each bit is held in place by said track at all times.

16. The adder of claim 13, wherein a complete traversal of said base by said track and said slider completes a rotation event.

17. The adder of claim 13, wherein said base is arranged such that an end thereof meets a beginning thereof.

18. The adder of claim 13, wherein said base is curved, and wherein said base and said track and said slider are adapted to move relative to each other such that said track and said slider traverse said base.

19. The adder of claim 13, wherein a horizontal dimension of said base is divided into units, wherein each bit position takes up four of said units, wherein said bit pins and said constant pins are positioned so that they are one unit apart in the horizontal dimension, and wherein said constant pins are one unit to the left of said bit pins.

20. The adder of claim 6, wherein the concatenation of values stored in said addend pins provides an actual addend value that is added to said accumulator during each rotation event and each overflow event, and wherein said bit pins store said accumulated value.

21. The adder of claim 6, wherein said bit pin drives said slider during a first cycle such that said slider reads said bit pin value; wherein said addend pin drives said slider during a second cycle to add said addend value to a bit value recorded for said bit; wherein said addend pin holds said slider and said slider drives said bit pin to switch said bit to an appropriate track during a third cycle to write said bit; and wherein said addend pin drives said slider such that it is positioned to be in a correct position for a next bit during a fourth cycle such that said adder is reset.

22. The adder of claim 6, wherein said adder provides an addition function that is symmetrical among three input bits, in which a count indicates the number of one's that are in said three inputs which correspond to four positions of said slider, such that the position of said slider counts the number of one's on said inputs.

23. The adder of claim 22, wherein said slider enters a bit position in which said slider is in either of a zero position or a one position, depending upon whether or not there is a carry input.

24. The adder of claim 23, wherein said slider is advanced one position when said bit pin is in said one position.

25. The adder of claim 24, wherein said slider is advanced if said addend is equal to one, and said slider is not advanced if said addend is equal to zero; and wherein said bit pin is steered to a neutral position by said track.

26. The adder of claim 25, wherein said addend pin holds said slider stationary, unless said slider is in position three, in which case said slider is reset; wherein said bit pin is steered from said neutral position to an appropriate output; and wherein said slider is reset to either said zero position or said one position, depending upon whether or not there is a carry output.

27. The adder of claim 6, wherein all constituent parts of said adder are in regular and continuous motion, such that friction is avoided.

28. The adder of claim 6, wherein said adder has a circular configuration, said adder further comprising:

a circular track in which time units T0, T1, T2, and T3 correspond to fixed angles, and in which all tracks that engage a same pin are curved on exactly a same radius.; and a plurality of bit levers which are placed on a base around said adder in a circle with each bit corresponding to a fixed angle.

29. A mechanical adder, comprising:

an accumulator;

a bit serial mechanical adder that adds an addend into said accumulator upon the occurrence of an addition event; and a plurality of levers that each further comprise a pin that represents a bit in said accumulator, wherein said levers can be set in one of two positions, where such positions represent a digital zero and one, respectively, where each lever is held in one of said two positions by a track device in which said pins slide.

30. The adder of claim 29, said track device further comprising:

at least two substantially parallel tracks; and a switch section which allows said pin to move from one track to another when a bit is written, wherein the switching of said pin is determined by a slider that rides over said switch section of said track device.

31. The adder of claim 30, further comprising:

a plurality of fixed pins that represent said addend, wherein there is one lever having a pin, and one fixed addend pin for each bit position.

32. The adder of claim 31, wherein said slider includes slots that engage said bit pins and said addend pins, respectively, wherein said track slides over each lever and engages said pin.

33. The adder of claim 32, wherein the concatenation of values stored in said addend pins provides an actual addend value that is added to said accumulator during each rotation event and each overflow event, and wherein said bit pins store said accumulated value.

34. The adder of claim 32, wherein said bit pin drives said slider during a first cycle such that said slider reads said bit pin value; wherein said addend pin drives said slider during a second cycle to add said addend value to a bit value recorded for said bit; wherein said addend pin holds said slider and said slider drives said bit pin to switch said bit to an appropriate track during a third cycle to write said bit; and wherein said addend pin drives said slider such that it is positioned to be in a correct position for a next bit during a fourth cycle such that said adder is reset.

35. The adder of claim 32, wherein said adder provides an addition function that is symmetrical among three input bits, in which a count indicates the number of one's that are in said three inputs which correspond to four positions of said slider, such that the position of said slider counts the number of one's on said inputs.

36. The adder of claim 29, wherein all constituent parts of said adder are in regular and continuous motion, such that friction is avoided.

* * * * *